United States Patent [19]

Diesch

[11] 4,112,801

[45] Sep. 12, 1978

[54] KNIFE ASSEMBLY FOR PHOTOGRAPHIC STRIP CUTTER

[75] Inventor: Robert E. Diesch, Rogers, Minn.

[73] Assignee: Pako Corporation, Minneapolis, Minn.

[21] Appl. No.: 837,998

[22] Filed: Sep. 29, 1977

[51] Int. Cl.[2] ..... B26D 5/08

[52] U.S. Cl. ..... 83/586; 83/635; 83/694; 83/223

[58] Field of Search ..... 83/575, 582, 583, 586, 83/628, 632, 635, 685, 686, 283, 223, 694

[56] References Cited

U.S. PATENT DOCUMENTS

| | | | |
|---|---|---|---|
| 3,320,842 | 5/1967 | Bailey et al. | 83/628 X |
| 3,466,959 | 9/1969 | Wharton | 83/223 X |
| 3,695,133 | 10/1972 | Finke | 83/283 X |
| 4,014,232 | 3/1977 | Mauger | 83/628 X |

*Primary Examiner*—Willie G. Abercrombie

*Attorney, Agent, or Firm*—David R. Fairbairn; John W. Adams

[57] ABSTRACT

A knife assembly capable of cutting photographic strip material with high accuracy at extremely high speeds includes a base, a stationary blade, a source of rotary power, a crank shaft, a spring-wrap clutch mechanism, first and second linear drive shafts, first and second adjustable linear bearings, and a movable blade. The spring-wrap clutch is mounted on the crank shaft for selectively imparting rotary power to the crank shaft, and the first and second linear drive shafts are connected to the drive shaft. The movable blade is connected between the ends of the first and second linear drive shafts.

18 Claims, 7 Drawing Figures

38b
36b
30b
32
30a
36a
38a 32
36b
34
36a 10
22b
22a

KNIFE ASSEMBLY FOR PHOTOGRAPHIC STRIP CUTTER

REFERENCE TO CO-PENDING APPLICATIONS

Reference is made to the following co-pending patent applications which are filed on Sept. 29, 1977, and are assigned to the same assignee as this application: "Microprocessor Controlled Photographic Paper Cutter" Ser. No. 838,064 by G. Strunc and F. Laciak; "Paper Drive Mechanism for Automatic Photographic Paper Cutter" Ser. No. 837,987 by R. Diesch; "Multichannel Indicia Sensor for Automatic Photographic Paper Cutter" Ser. No. 837,986 by R. Diesch and G. Strunc; "Stepper Motor Control" Ser. No. 837,988 by G. Strunc; "Print and Order Totalizer for Automatic Photographic Paper Cutter" Ser. No. 838,065 by G. Strunc; "Paper Feed Control for Automatic Photographic Paper Cutter" Ser. No. 838,000 by R. Diesch and G. Strunc; and "Photographic Paper Cutter with Automatic Paper Feed in the Event of Occasional Missing Cut Marks" Ser. No. 837,999 by G. Strunc. These co-pending applications describe various aspects of a photograhic paper cutter in which the knife assembly of the present invention has been used to considerable advantage.

BACKGROUND OF THE INVENTION

The present invention relates to photographic processing equipment. In particular, the present invention relates to an improved knife assembly for use in cutters of photographic strip materials such as photographic paper or photographic film. As used in the present application, the term "knife assembly" includes assemblies which make the single cut and those assemblies which actually punch out material of a desired shape from the photographic strip.

In commercial photographic processing operations, very high rates of processing must be achieved and maintained in order to operate profitably. To expedite the photographic processing, orders containing film of similar type and size are spliced together for developing. As many as 500 to 1000 rolls of 12, 20, and 36 exposure film may be spliced together for processing and printing purposes.

After developing, the photographic images contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of print paper has been photoprocessed to produce prints, a photographic paper cutter cuts individual prints from the strip. The prints are then sorted by customer order and ultimately packaged and sent to the customer.

The desire for high rates of processing within commercial photographic processing operations has led to the development of extremely high speed automatic paper cutters. Automatic paper cutters capable of cutting over 25,000 prints per hour (i.e. over seven prints per second) are needed, and are being developed.

The extremely high speed requirements of newly developed automatic paper cutters places extreme demands on the knife assembly. First, mechanical stability of the knife assembly becomes extremely critical in order to obtain high blade life and relatively clean cuts of the photographic paper. Because the photographic paper has a rag content and has a polyethylene coating on its top surface, it is difficult to cut without very precise and close relationship between the fixed and moving blades of the knife assembly. It has been determined that a gap of about 0.0003 inch is a maximum gap which can exist between the fixed and moving blades and still obtain acceptable paper cuts which do not have torn or ragged edges.

The prior art knife assemblies are not capable of providing acceptable quality paper cuts with long blade life at the extremely high speeds now desired for a paper cutter. The prior art knife assemblies generally contain a great deal of flexibility or sloppiness in the drive mechanism which preclude obtaining the desired tolerances in the relationship between the fixed and moving blades. In addition, the prior art knife assemblies have been generally slow because they have used rather massive movable blades and blade mounts in an attempt to obtain stability in the system. The extremely large mass of the prior art knife assemblies makes it extremely difficult to drive the knife at high speeds with a reasonably-sized motor.

SUMMARY OF THE INVENTION

The knife assembly of the present invention is an extremely stable knife assembly capable of providing clean cuts with high blade life at extremely high speeds. The knife assembly includes a base, stationary blade means, a source of rotary power, a crank shaft, a clutch, first and second linear drive shafts, movable blade means, and first and second adjustable linear bearing means. This assembly permits extremely close tolerances to be maintained without necessitating excessive mass of the assembly or unrealistic tolerances for the component parts.

DETAILED DESCRIPTION OF THE PREFERRED EMBODIMENTS

Figures 1A, 2A, 2B:
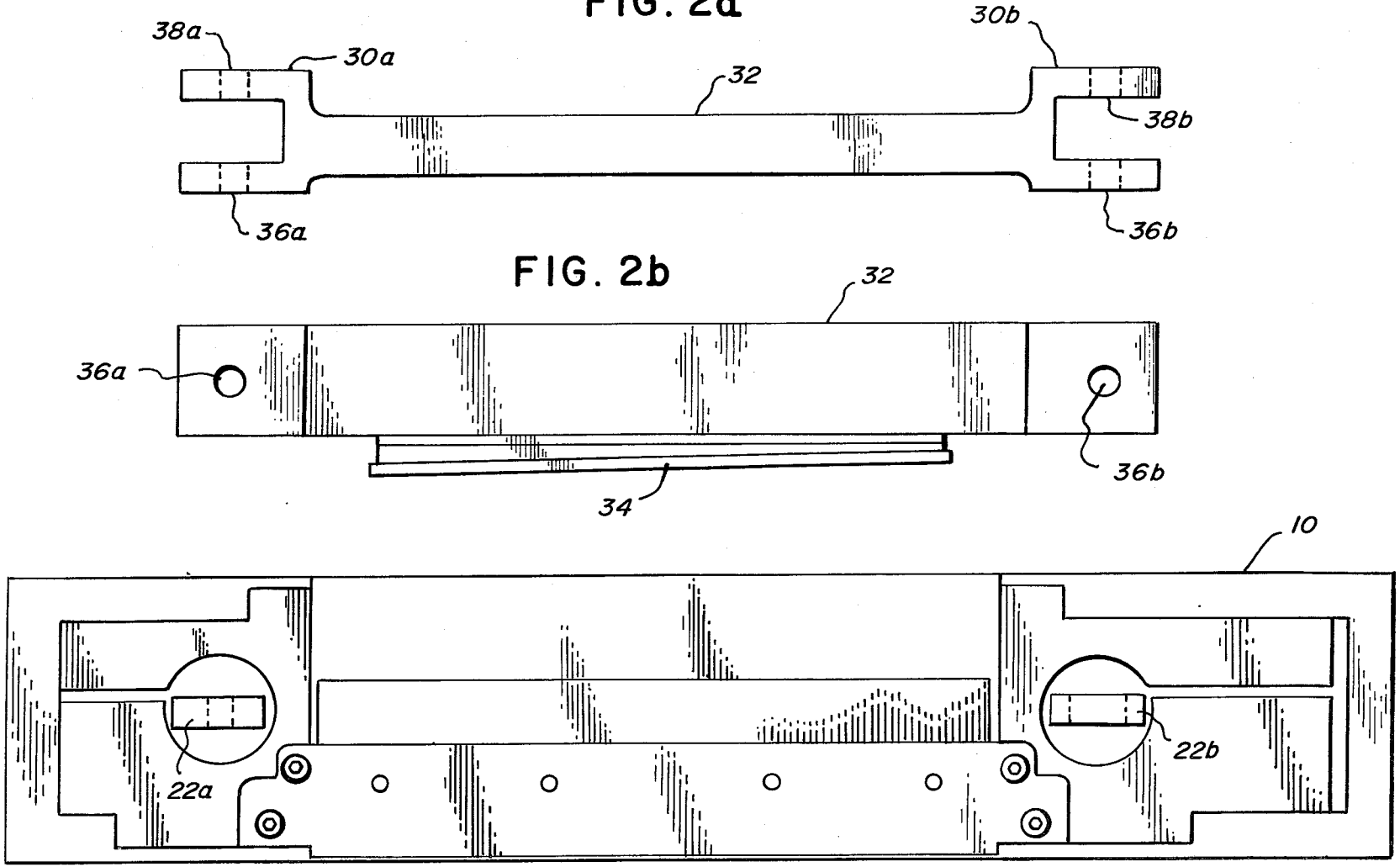
FIGS. 1*a* and 1*b* are top and front views, respectively, of the knife assembly with the movable blade removed.
FIGS. 2*a* and 2*b* are top and front views, respectively, of the movable blade used in conjunction with the knife assembly of FIGS. 1*a* and 1*b*.
Figure 1B:
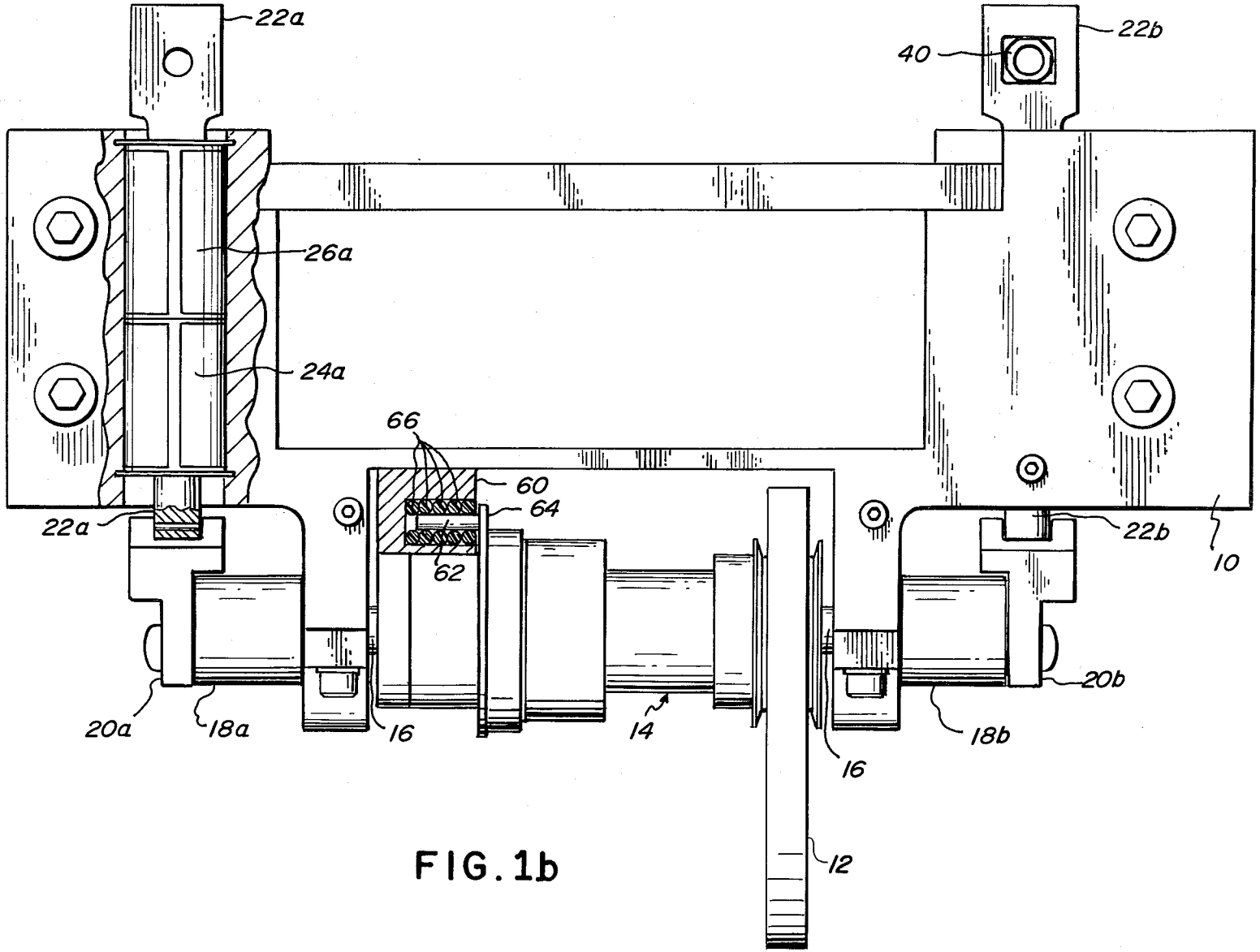

FIGS. 1*a* and 1*b* show the knife assembly with the movable blade removed. The knife assembly of the present invention includes a base or block 10 which supports the entire knife assembly. Rotary power is supplied to the knife assembly by a timing belt 12 which is connected to an AC motor (not shown). Timing belt 12 supplies the rotary power to spring-wrap clutch 14, which in a preferred embodiment is a Warner CB-4 single revolution spring-wrap clutch. Other spring-wrap clutches may be used, provided that they are relatively small so as to minimize heat buildup at the high operating speeds desired. Clutch 14 preferably has three internal springs, one for engaging and picking up the rotary motion, one to act as a brake to stop the device in one revolution, and one which acts as a brake to eliminate backlash or rebound problems. Spring-wrap clutch 14 is solenoid activated, and provides a very repeatable incremental single revolution motion.

To convert the rotary motion to a linear motion required for cutting, crank shaft 16 is provided. Spring-wrap clutch 14 does not work on the crank shaft itself, but rather has its own internal shaft. In a preferred embodiment, the internal shaft has a ½ inch diameter and crank shaft has a ⅜ inch diameter. Because the bending moment applied to crank shaft 16 is great, and the diameter is rather small (⅜ inch), crank shaft 16 is preferrably formed from a particularly strong heat-treated alloy steel such as 4340 heat-treated alloy.

Attached to crank shaft 16 are two end caps 18*a* and 18*b* which are keyed and pressed onto crank shaft 16 at opposite ends. Caps 18*a* and 18*b* provide the journals which provide the offset for the crank shaft operation. A preferred embodiment, the offset provided by end caps 18*a* and 18*b* is ⅛ inch, for a total of a ¼ inch displacement per revolution.

Connecting links 20*a* and 20*b* connect crank shaft end caps 18*a* and 18*b* with linear drive shafts or uprights 22*a* and 22*b*, respectively. Uprights 22*a* and 22*b* extend through block 10 and provide the connection to the movable blade.

In FIG. 1*a*, a portion of block 10 has been broken away to reveal upright 22*a* as it runs in linear bearings 24*a* and 26*a*. Similarly, linear drive shaft 22*b* runs in a pair of adjustable linear bearings which are not shown, but which are identical to bearings 24*a* and 26*a*. Top bearing 24*a* is sealed at the top to prevent contamination by paper dust produced during the paper cutting operation.

In the preferred embodiment, the adjustable linear bearings are precision 6 race bearings manufactured by Heim. In order to maintain the precise positioning required in the present invention, the linear bearings are adjusted to run at a preload, in other words, an interference fit between the upright and the bearing. Uprights 22*a* and 22*b* form the inner race of their respective linear bearings and, for that reason, must have a Rockwell hardness of greater than 60C. In a preferred embodiment, uprights 22*a* and 22*b* run at a 0.001 inch interference fit with their respective linear bearings. After initial break in of uprights 22*a* and 22*b* and their respective adjustable linear bearings, the location of the uprights are very precisely controlled and very predictable.

FIGS. 2*a* and 2*b* show movable blade 28, which includes forked mounting portions 30*a* and 30*b*, a blade support 32, and a blade 34 which extends below the blade support 32. Forked mounting portions 30*a* and 30*b* have mounting holes 36*a*, 38*a*, 36*b* and 38*b* for receiving mounting pins which pass through mounting holes on uprights 22*a* and 22*b*. In the preferred embodiments of the present invention, the entire movable blade assembly, including the mounting portions, the blade support and the blade, are formed from a single body of steel hardened to 60 to 62 RockwellC. It has been discovered that with the present invention a separate blade support and blade is extremely difficult to maintain with the desired straightness so that the tolerances between the movable blade and the stationary blade are maintained. Attempts to mount a separate blade on a blade support resulted in significant distortion of the blade or the blade support. The use of an integral single body for the blade support and blade eliminates the need for perfectly flat mounting surfaces and constant temperature operation, neither of which are attainable at realistic cost.

As shown in FIG. 1*b*, the mounting hole for upright 22*b* is in the form of a movable insert which slides in a slot in upright 22*b*. The location of the mounting hole, therefore, can vary in the direction normal to the axis of upright 22*b*. This permits a relaxation of the tolerances which otherwise would be required in the spacing of the axes of uprights 22*a* and 22*b* and the spacing of mounting holes 36*a*–36*b* and 38*a*–38*b* of the knife assembly. The use of movable insert 40 provides significant advantage in the present invention since it makes the required tolerances practical and obtainable at reasonable cost.

Figure 3A:
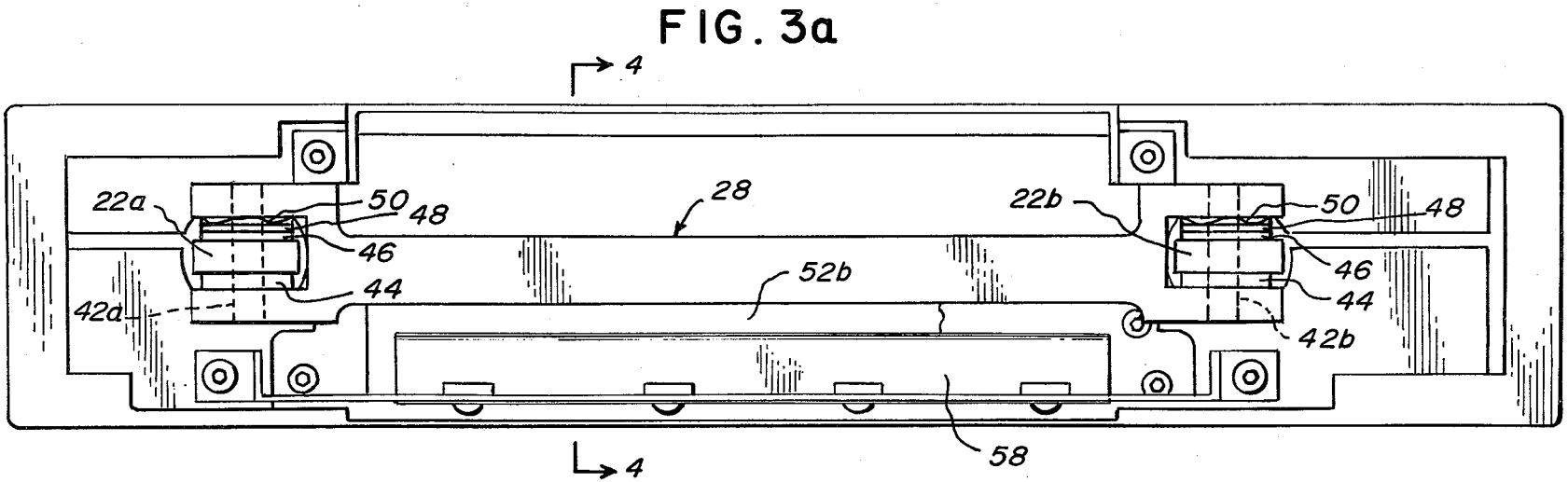
FIGS. 3*a* and 3*b* are top and front views, respectively, of the entire knife assembly with the movable blade mounted.
Figure 3B:
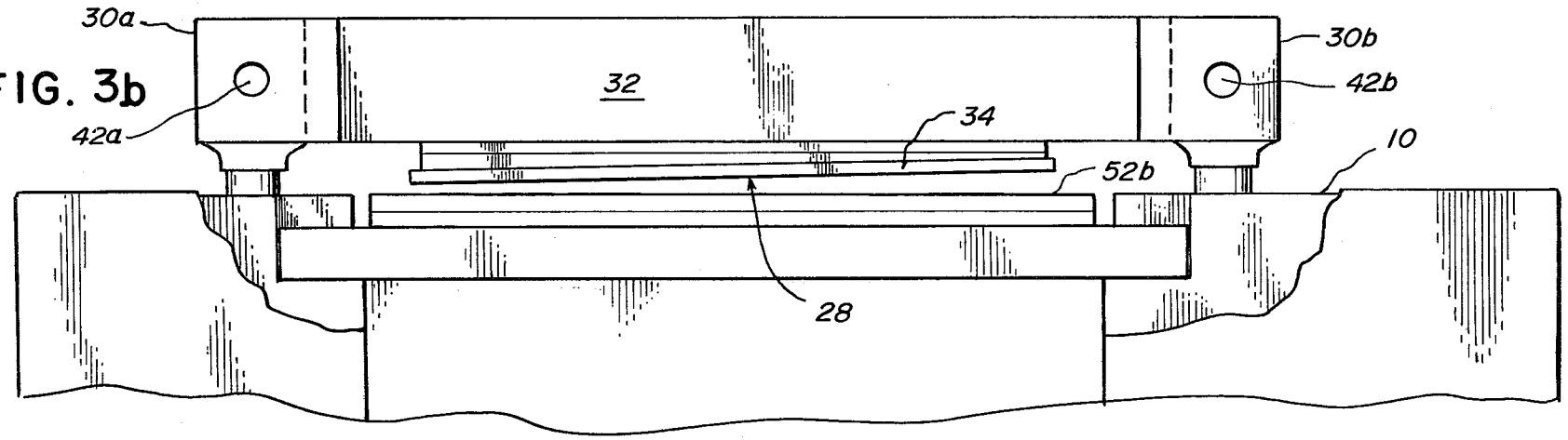

FIG. 3 shows a top view of the knife assembly with movable blade 28 mounted. The mounting is achieved using pins 42*a* and 42*b*. Pins 42*a* and 42*b* are free-floating to permit slight rotation about the pin on blade 28 caused by slight differences in the lengths of uprights 22*a* and 22*b*. The differences in length are very slight (a few thousandths of an inch) but must be accommodated in order to relax the tolerances required for uprights 22*a* and 22*b*.

Blade 28 is located relative to uprights 22*a* and 22*b* by a flat (or locating surface) on the upright and a flat (or locating surface) on the blade mounting portion. Inserted are thrust washers 44 and 46, spacer washer 48 (which acts as a backing plate for thrust washer 46), and Belville spring 50. Belville spring 50 is inserted to take up slack and force the movable blade assembly against one of the locating surfaces. In a preferred embodiment, Belville spring 50 actually comprises two Belville washers in series to give 260 lbs. of axially compressive load.

Figure 4:
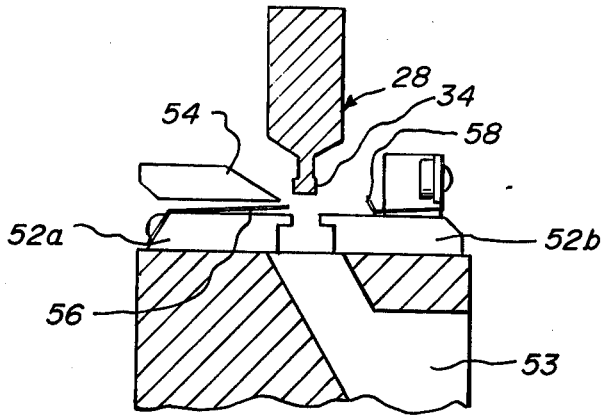
FIG. 4 is a cross-sectional view along section line 4—4 in FIG. 3*a*.

In a preferred embodiment of the present invention, there are three sets of blades: one for round cornered borderless prints, one for straight borderless prints, and one for straight bordered prints. Both the round cornered and straight borderless blade assemblies operate as a punch and die operation which punches out a slug of paper. FIG. 4 shows a cross-sectional view of the knife assembly when the round cornered borderless blade assembly is being used. As shown in FIG. 4, the lower stationary blades 52*a* and 52*b* actually form a "die" which receives a "punch" (i.e. movable blade 28). The paper is actually punched out by the downward force of movable blade 28 and passes through an opening 53 underlying the stationary die or blade 52. Also shown in FIG. 4 is a stripper 54 and springs 56 and 58. Stripper 54 strips the paper material off blade 34 as it is retracted from the fixed blades. Spring 56 lifts the paper slightly above the blade 52*a* so that it will not hang up on the front edge of blade 52*b* if the paper happens to be curled. Finally, spring 58 holds the print that has just been cut underneath spring 58 until the next print is cut. When the next print is cut, it rides over the top of the previous print and, because of the contact between the two, forces the previously cut print out from under spring 58. The prints, therefore, are layered as they come out to produce a stack of prints.

In the case of straight bordered prints, only a single stationary cutting edge is provided, so that the movable blade actually shears the paper along cutting line rather than punching out material. In either case, however, the operation of the knife assembly remains the same and only the blades are changed.

One important advantage of the knife assembly of the present invention is that the crankshaft causes the loading on the spring-wrap clutch to be in a sinusoidal form. This permits operating with minimal inertial forces so as not to demand excessive amounts of power from the motor which drives belt 12 and does not place excessive forces on clutch 14. This is an extremely important consideration in view of the very high operating speeds and component life that are desired.

In addition, an impact absorbing structure is provided through which clutch assembly communicates with base 10. A pin 62 is welded to clutch plate 64 and communicates with block 60, which is attached to base 10. A plurality of rubber O rings 66 surround pin 62 within the receiving bore of block 60. The purpose of this impact absorbing structure is to absorb the impulse load on the entire knife assembly which occurs when movable blade 28 impacts the photographic paper.

The impact absorbing structure permits spring-wrap clutch 14 to move axially along the axis of the crank shaft. Since it is the nature of the spring-wrap clutch mechanism that it must be permitted to float axially along the crank shaft, the impact absorbing structure must not add any side loading to the clutch.

Still another advantage of the present invention is that the knife assembly is a unitized structure except for the motor and timing belt 12 which initially provide the rotary power. It is possible, therefore, to eliminate expensive duplicate parts or assemblies common in the prior art motor and knife assemblies. In addition, the unitized structure of the present invention significantly simplifies replacement.

In conclusion, the present invention is a knife assembly which is capable of extremely high speed (i.e. over seven prints cut per second) operation. It does not require excessive power, it makes high quality paper cuts, and it allows long blade life without requiring unrealistic, unattainable tolerances for its component parts.

Although the present invention has been described with reference to the preferred embodiments, workers skilled in the art will recognize that changes may be made in form and detail without departing from the spirit and scope of the invention.

What is claimed is:

1. A knife assembly for cutting photographic strip material, the knife assembly comprising:

a base;

stationary blade means mounted to the base;

a source of rotary power;

a crankshaft for rotation about a crankshaft axis;

clutch means for selectively imparting the rotary power from the source of rotary power to the crankshaft;

first and second linear drive shafts connected to the crankshaft and extending through the base along first and second drive shaft axes which are substantially parallel to one another and normal to the crankshaft axis;

first and second linear bearing means mounted in the base along the first and second drive shaft axes, the first and second linear drive shafts and the first and second linear bearing means, respectively, forming an interference fit; and movable blade means connected between the first and second linear drive shafts, whereby a single revolution of the crankshaft causes the movable blade means to engage the stationary blade means and cut the strip material and then withdraw to a non-engaging rest position.

2. The knife assembly of claim 1 wherein the first and second linear bearing means are adjustable linear bearings.

3. The knife assembly of claim 1 and further comprising:

first and second connecting pins for connecting the movable blade means to the first and second linear drive shaft means, respectively.

4. The knife assembly of claim 3 wherein the first and second connecting pins extend through openings in the first and second linear drive shaft means and corresponding openings in the movable blade means.

5. The knife assembly of claim 4 wherein the first and second connecting pins are positioned along first and second pin axes which are essentially normal to the first and second drive shaft axes, respectively, and wherein the first and second connecting pins permit partial rotation of the movable blade means about the first and second pin axes.

6. The knife assembly of claim 5 wherein the first and second drive shafts include first and second locating surfaces essentially normal to the first and second pin axes, respectively, and wherein the assembly further comprises:

spring means for applying force to the movable blade means along the first and second pin axes to hold the movable blade means in a position defined by the first and second locating surfaces.

7. The knife assembly of claim 6 wherein the spring means comprises Belville springs.

8. The knife assembly of claim 4 wherein the opening in the second linear drive shaft means comprises:

a slot-like opening in the second linear drive shaft means;

a movable insert mounted in the slot-like opening for movement in a direction essentially normal to the first and second drive shaft axes; and a pin receiving opening in the movable insert for receiving the second connecting pin.

9. The knife assembly of claim 1 wherein the clutch means comprises a spring-wrap clutch mounted on the crankshaft.

10. The knife assembly of claim 9 and further comprising:

impulse absorbing means mounted between the spring-wrap clutch and the base.

11. The knife assembly of claim 1 wherein the movable blade means comprises:

a blade mount connected to and extending between the first and second linear drive shafts; and a blade connected to and extending below the blade mount to engage the stationary blade means and cut the strip material when the knife assembly is actuated.

12. The knife assembly of claim 11 wherein the blade mount and the blade are a unitary body formed from a single piece of material.

13. A knife assembly for cutting photographic strip material, the knife assembly comprising:

a base;

stationary blade means mounted to the base;

a source of rotary power;

a crankshaft for rotation about a crankshaft axis;

clutch means for selectively imparting the rotary power from the source of rotary power to the crankshaft;

first and second linear drive shafts connected to the crankshaft and extending through the base along first and second drive shaft axes which are substantially parallel to one another and normal to the crankshaft axis;

movable blade means extending between the first and second linear drive shafts;

first connecting means for connecting the movable blade means to the first linear drive shaft; and second connecting means for connecting the movable blade means to the second linear drive shaft, the second connecting means being movable along an axis essentially normal to the first and second drive shaft axes.

14. The knife assembly of claim 13 wherein the first connecting means comprises:

a first connecting pin, and corresponding pin receiving openings in the movable blade means and the first drive shaft means.

15. The knife assembly of claim 14 wherein the second connecting means comprises:

a second connecting pin;

a pin receiving opening in the movable blade means;

a slot-like opening in the second linear drive shaft means;

a movable insert mounted in the slot-like opening for movement in a direction essentially normal to the first and second drive shaft axes; and a pin receiving opening in the movable insert for receiving the second connecting pin.

16. The knife assembly of claim 15 wherein the first and second connecting pins are positioned along first and second pin axes which are essentially normal to the first and second drive shaft axes, respectively, and wherein the first and second connecting pins permit partial rotation of the movable blade means about the first and second pin axes.

17. The knife assembly of claim 16 wherein the first and second drive shafts include first and second locating surfaces essentially normal to the first and second pin axes, respectively, and wherein the assembly further comprises:

spring means for applying force to the movable blade means along the first and second pin axes to hold the movable blade means in a position defined by the first and second locating surfaces.

18. The knife assembly of claim 17 wherein the spring means comprises Belville springs.

* * * * *